US006962232B2

(12) United States Patent
Diggle et al.

(10) Patent No.: US 6,962,232 B2
(45) Date of Patent: Nov. 8, 2005

(54) TORSO HARNESS

(75) Inventors: Frederick J. Diggle, Birmingham, AL (US); Michael White, Boaz, AL (US)

(73) Assignee: BellSouth Intellectual Property Corporation, Wilmington, DE (US)

( * ) Notice: Subject to any disclaimer, the term of this patent is extended or adjusted under 35 U.S.C. 154(b) by 2 days.

(21) Appl. No.: 10/648,621

(22) Filed: Aug. 26, 2003

(65) Prior Publication Data

US 2005/0045420 A1 Mar. 3, 2005

(51) Int. Cl.[7] ..... A62B 1/16
(52) U.S. Cl. ..... 182/6; 2/455
(58) Field of Search ..... 182/3, 6, 7; 2/455

(56) References Cited

U.S. PATENT DOCUMENTS

| | | | | | |
|---|---|---|---|---|---|
| 1,190,389 | A * | 7/1916 | Erwin | 182/193 |
| 1,775,736 | A * | 9/1930 | Rose | 182/6 |
| 2,252,998 | A * | 8/1941 | Wachtel | 182/6 |
| 3,176,686 | A * | 4/1965 | Barnes | 128/846 |
| 3,647,171 | A | 3/1972 | Rafferty | |
| 4,103,758 | A | 8/1978 | Himmelrich | |
| 4,341,285 | A * | 7/1982 | Krickovich | 182/6 |
| 5,884,340 | A * | 3/1999 | Chen et al. | 2/455 |
| 6,161,647 | A | 12/2000 | Braden | |
| 6,189,651 | B1 | 2/2001 | Sadeck | |
| 6,283,248 | B1 * | 9/2001 | Groover | 182/6 |
| 6,481,528 | B2 | 11/2002 | Antonio | |
| 6,527,082 | B1 | 3/2003 | Taylor | |
| 2002/0074185 | A1 | 6/2002 | Colorado | |
| 2003/0010567 | A1 | 1/2003 | Gayetty | |

* cited by examiner

*Primary Examiner*—Alvin Chin-Shue
(74) *Attorney, Agent, or Firm*—Walters & Zimmerman; Jennifer Medlin; Todd Mitchem

(57) ABSTRACT

A torso harness reduces injury from a fall from a utility pole. The torso harness has a safety belt for wrapping around the waist of a person. A single strap forms a left and a right leg loop. The single strap has a first end secured to the safety belt and a second end secured to the safety belt. The single strap also has a clasp sliding along the single strap. The single strap pulls between the legs of the person and up through the groin area. When the clasp is secured to the safety belt, the single strap thus forms the left and the right leg loop.

5 Claims, 10 Drawing Sheets

TORSO HARNESS

NOTICE OF COPYRIGHT PROTECTION

A portion of the disclosure of this patent document and its figures contain material subject to copyright protection. The copyright owner has no objection to the facsimile reproduction by anyone of the patent document or the patent disclosure, but the copyright owner otherwise reserves all copyrights whatsoever.

BACKGROUND OF THE INVENTION

1. Field of the Invention

This invention generally relates to fires escapes, ladders, and scaffolding and, more particularly, to torso harnessing.

2. Description of the Related Art

In the telecommunications or electronics industry, it is common practice for a technician (also referred to as a "linesman") to climb a utility pole. The technician climbs the utility pole to install equipment, to repair broken or damaged communications equipment, to test equipment, and/or for other work-related reasons. In order to safely and effectively climb a pole and perform line work, the technician must maintain and properly utilize various types of climbing equipment. To utilize the various types of climbing equipment, the technician must also have the skills and the physical ability to sustain a great strain on their legs and back while the technician climbs and/or maintains a position about the pole.

Conventional climbing equipment employed by a technician typically includes a pair of gaffs, a body belt, and/or a safety strap. In general, the gaff is a sharp blade protruding from the inside of the foot about mid-foot level and having straps that secure about the leg and/or feet of a technician. To climb, the technician drives one of the gaffs into the pole, steps up onto the gaff, and then drives the other gaff into the pole at a higher position. The technician continues taking steps up or "gaffs up" the pole until reaching a desired height.

The body belt is secured around the waist of the technician. The body belt includes pockets for carrying tools and rings (e.g., "D-rings") for attaching the safety strap. The safety strap typically includes a hook (e.g., snap buckle) at each end and a buckle for adjusting its length. During climbing, both hooks of the safety strap are attached to the same ring of the body belt on the left hip. Once in a position to perform line work, the technician releases one end of the safety strap from the body belt. The technician then wraps the safety strap around the pole and reattaches the end of the safety strap to the body belt, thus allowing the technician to use his hands at the desired working elevation. Thus, the technician uses the safety strap for climbing as well as supporting the technician in his working position about the pole.

During elevated line work, both gaffs are pressed into the pole and the technician leans back against the safety strap. This position allows the weight of the technician to be supported by the gaffs and the tension in the safety strap. An error in technique or defect in equipment, however, may result in serious injury to the technician. For example, there are times when a gaff dislodges or "cuts out" from the pole. If one or both of the gaffs cuts out, the technician may (i) fall straight down from atop the pole, (ii) rotate downward and fall on the head, (iii) get one or more gaffs back into the pole, and (iv) may reach out to grab/hug the pole. In many of these scenarios, the technician may, and often does, sustain injury such as to the knees, back, and/or arms.

Safety devices have been proposed for supporting the weight of the technician to prevent accidents as described above; however, the usefulness of such safety devices depends upon the willingness of the technician to use them which in turn relies upon whether such devices are conveniently and easily used in the field. As an alternative to climbing the pole, some technicians resort to using ladders or bucket trucks to perform elevated line work so as to avoid the risk of injury from a fall. This solution requires the purchase and maintenance of additional equipment and, thus, results in increased expenses for the technician's employer. In addition, work related injuries still occur when using and transporting a ladder of the size necessary to reach the top of a pole.

BRIEF SUMMARY OF THE INVENTION

The aforementioned problems, and other problems, are reduced by a torso harness. Should a technician fall from a utility pole, this torso harness helps reduce, and perhaps even prevent, injury to the technician. The torso harness of this invention utilizes a safety belt and a single strap. This single strap forms both a left and a right leg loop. Should the technician fall from the utility pole, the single strap, forming the leg loops, helps retain the safety belt around the waist of the technician. Because the safety belt is retained around the waist, the safety belt is less prone to "slipping up" and injuring the ribs, chest, and other body areas. The torso harness of this invention also includes a groin protector to further reduce injury from an impact to the groin area.

One of the embodiments of this invention describes a torso harness for reducing injury from a fall from a utility pole. The torso harness has a safety belt for wrapping around the waist of a person. A single strap forms a left and a right leg loop. The single strap has a first end secured to the safety belt and a second end secured to the safety belt. The single strap also has a clasp sliding along the single strap. The single strap pulls between the legs of the person and up through the groin area. When the clasp is secured to the safety belt, the single strap thus forms the left and the right leg loop.

Another of the embodiments of this invention also describes a torso harness for reducing injury from a fall from a utility pole. This torso harness has a safety belt for wrapping around the waist of a person. A left and a right leg loop attach to the safety belt, with the left and the right leg loops for insertion of the corresponding legs of the person. A groin protector secures between the left and the right leg loop, and the groin protector reduces injury from an impact to the groin area.

Still more embodiments of this invention describe methods for reducing injury from a fall from a utility pole. A safety belt is donned around the waist of a person. A first end of a single strap is secured to the safety belt. A second end of the single strap is also secured to the safety belt. The single strap has a clasp sliding along the single strap. When the single strap is pulled between the legs of the person and up through the groin area, and the clasp is secured to the safety belt, the single strap thus forms a left and a right leg loop.

Other systems, methods, and/or computer program products according to embodiments will be or become apparent to one with skill in the art upon review of the following drawings and detailed description. It is intended that all such additional systems, methods, and/or computer program products be included within this description, be within the scope of the present invention, and be protected by the accompanying claims.

BRIEF DESCRIPTION OF THE SEVERAL VIEWS OF THE DRAWINGS

These and other features, aspects, and advantages of this invention are better understood when the following Detailed Description of the Invention is read with reference to the accompanying drawings, wherein.

DETAILED DESCRIPTION OF THE INVENTION

This invention now will be described more fully hereinafter with reference to the accompanying drawings, in which exemplary embodiments are shown. This invention may, however, be embodied in many different forms and should not be construed as limited to the embodiments set forth herein; rather, these embodiments are provided so that this disclosure will be thorough and complete, and will fully convey the scope of the invention to those of ordinary skill in the art. Moreover, all statements herein reciting embodiments of the invention, as well as specific examples thereof, are intended to encompass both structural and functional equivalents thereof. Additionally, it is intended that such equivalents include both currently known equivalents as well as equivalents developed in the future (i.e., any elements developed that perform the same function, regardless of structure).

This invention is a torso harness. Should a technician fall from a utility pole, this torso harness helps reduce, and perhaps even prevent, injury to the technician. The torso harness of this invention utilizes a safety belt and a single strap. This single strap forms both a left and a right leg loop. Should the technician fall from the utility pole, the single strap, forming the leg loops, helps retain the safety belt around the waist of the technician. Because the safety belt is retained around the waist, the safety belt is less prone to "slipping up" and injuring the ribs, chest, and other body areas. The torso harness of this invention also includes a groin protector to further reduce injury from an impact to the groin area.

Figure 1:
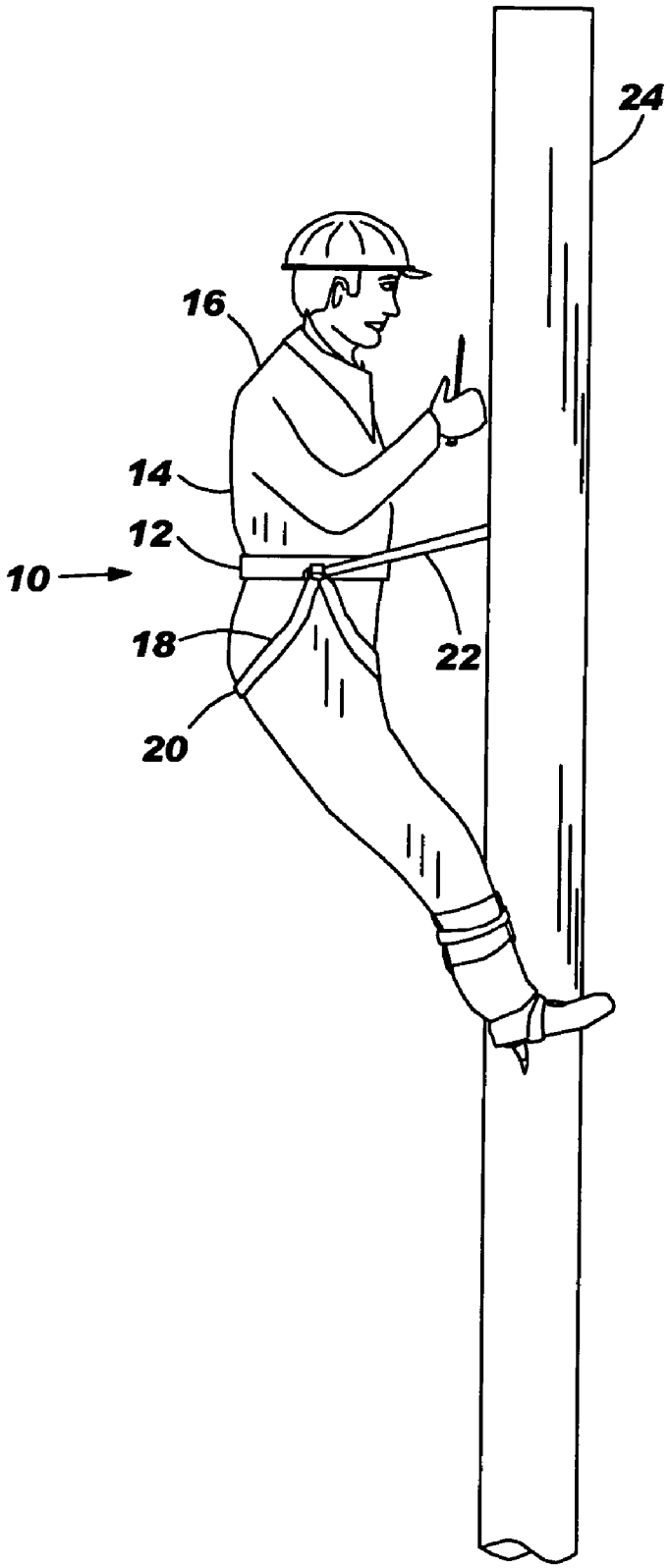
FIGS. 1 and 2 are schematics showing one of the embodiments of a torso harness.

FIG. 1 is a schematic showing an embodiment of a torso harness 10. The torso harness 10 has a safety belt 12 that wraps around the waist 14 of a person, such as a technician 16. The torso harness 10 also has a single strap 18 forming both a right leg loop 20 and a left leg loop (not shown). A safety strap 22 typically secures the torso harness 10 to a utility pole 24. As this patent will explain, should the technician 16 fall from the utility pole 24, the single strap 18 helps retain the safety belt 12 around the waist 14 of the technician 16. Because the safety belt 12 is retained around the waist 14, the safety belt 12 is less prone to "slipping up" and injuring the ribs, chest, and other body areas.

Figure 2:
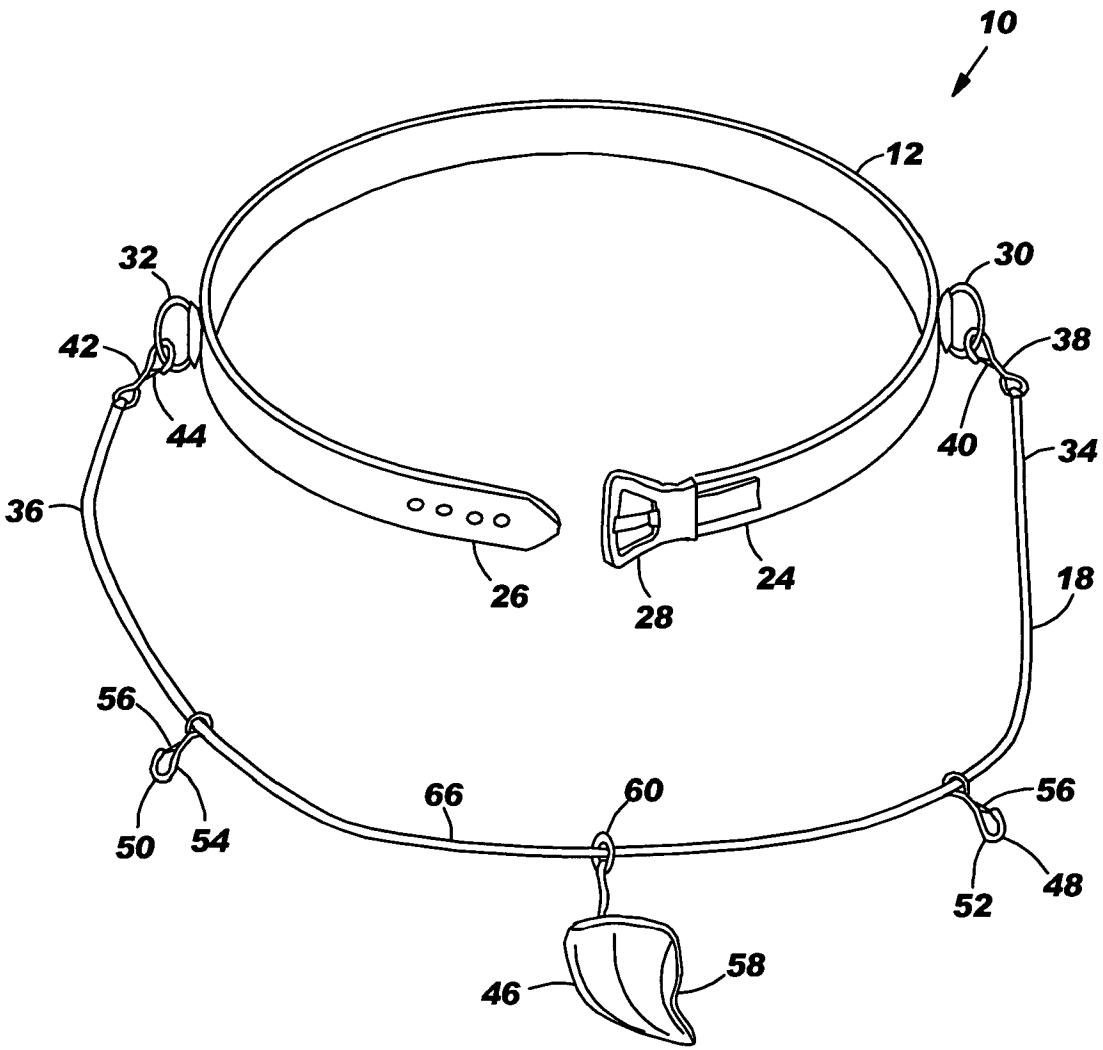

FIG. 2 is a detailed schematic of the torso harness 10 shown in FIG. 1. The safety belt 12 typically has an elongate shape with a first end 24 and a second end 26. The torso harness 10 also includes means for releasably securing the first end 24 to the second end 26. The means for releasably securing the first end 24 to the second end 26 is shown as a buckle 28. The means for releasably securing the first end 24 to the second end 26, however, may include a latch, a clasp, a hook, and/or a fastener (such as a threaded bolt and/or a hook and loop fastener). The safety belt 12 is constructed of a flexible, but strong, material, such as nylon and/or other polymer, leather, and/or cotton. The safety belt 12 may also be constructed of reinforced materials and include a breathable covering.

The torso harness 10 also includes the single strap 18. As this patent will explain, the single strap 18 forms both the right leg loop and the left leg loop (neither shown for simplicity). The safety belt 12 includes a left ring 30 and a right ring 32. The left ring 30 and the right ring 32 are shown as "D"-shaped rings, and these "D"-shaped rings are common in the harnessing art. The left ring 30 is proximate a left hip location of the technician, while the right ring 32 is proximate a right hip location (the technician is shown as reference numeral 16 in FIG. 1). A first end 34 of the single strap 18 secures to the left ring 30, while a second end 36 of the single strap 18 secures to the right ring 32. The single strap 18, for example, includes means for releasably securing the first end 34 and the second end 36 to the safety belt 12. The means for releasably securing the first end 34 of the single strap 18 is shown as a locking hook 38. The locking hook 38 is commonly referred to as a ladder hook or a snap hook. The locking hook 38 has a safety clasp 40 or other feature that helps prevent unintentional detachment from the support device. The means for releasably securing the second end 36 of the single strap 18 is similarly shown as a locking hook 42 with a safety clasp 44. The means for securing the first end 34 and the second end 36 may additionally or alternatively include a single/double/triple pass buckle, an "S"-shaped hook, a gated/hinged/threaded carabiner, a bolt, and/or a pin.

The single strap 18 also includes at least one clasp and a groin protector 46. A first clasp 48 and a second clasp 50 slide along the single strap 18. The clasps 48 and 50 are shown, respectively, as locking hooks 52 and 54. The locking hooks 52 and 54 are commonly referred to as ladder hooks or snap hooks, and each includes a safety clasp 56 or other feature that helps prevent unintentional detachment from the support device. The clasps 48 and 50 may additionally or alternatively include a single/double/triple pass buckle, an "S"-shaped hook, a gated/hinged/threaded carabiner, a bolt, and/or a pin. The groin protector 46 similarly slides along the single strap 18 and reduces injury from an impact to the groin area of the technician (shown as reference numeral 16 in FIG. 1). The groin protector 46 preferably has a rigid cup-shaped body 58 and an outwardly extending eyelet 60. The single strap 18 inserts into and through the eyelet 60.

Figure 3:
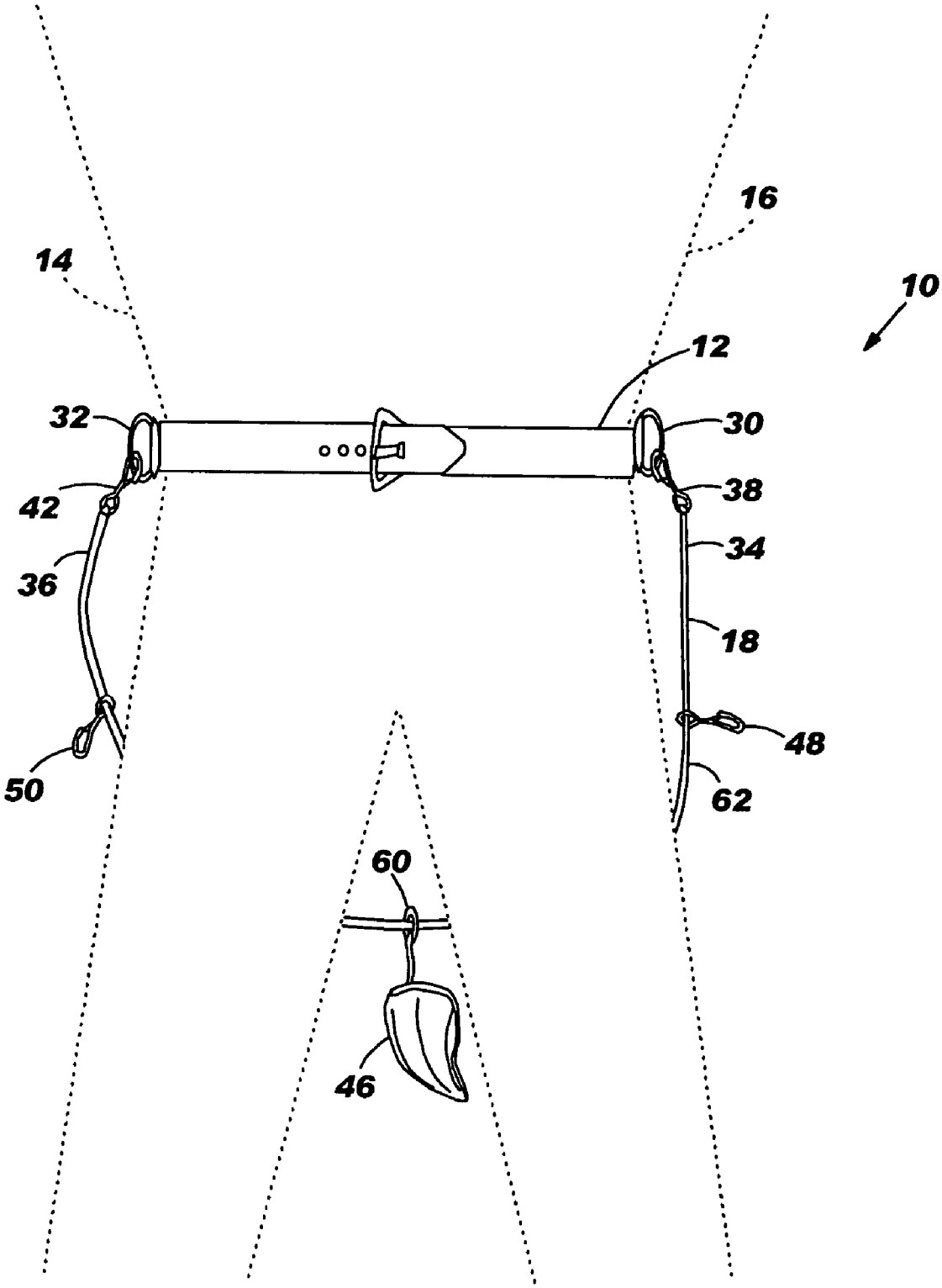
FIGS. 3–7 are schematics illustrating a technician donning the torso harness.
Figure 4:
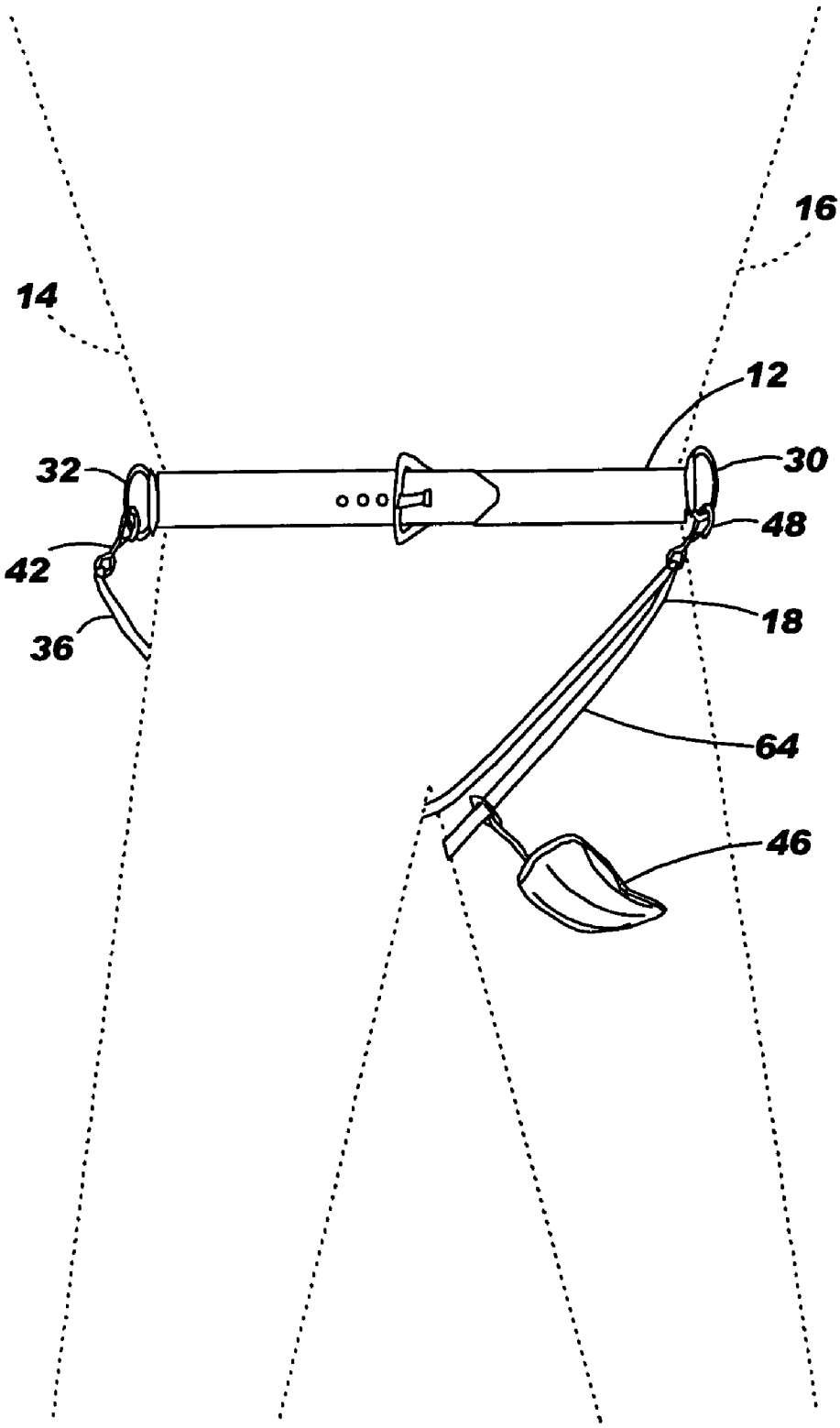
Figure 5:
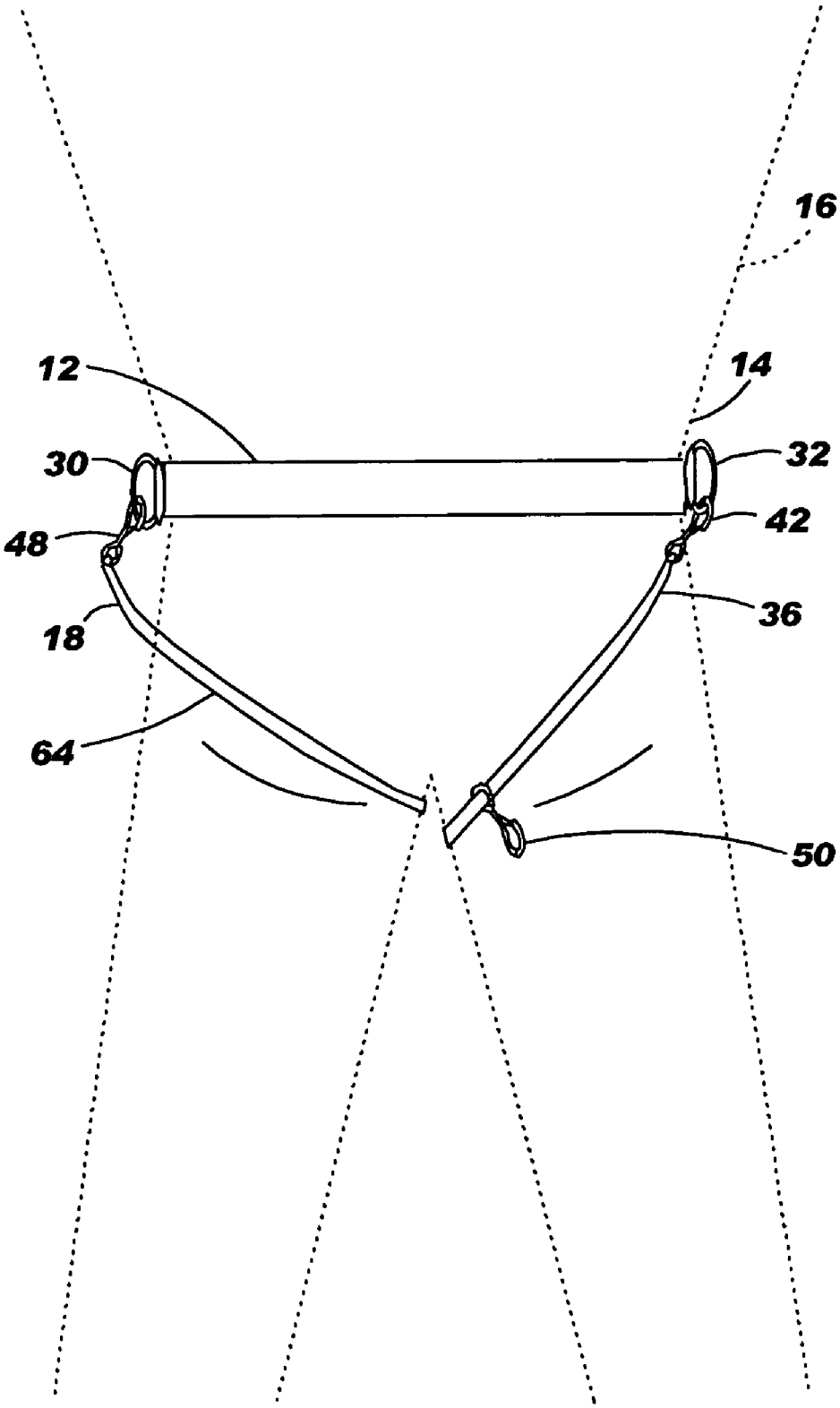

FIGS. 3–7 are schematics illustrating the technician 16 donning the torso harness 10. FIG. 3 shows an initial step for donning the torso harness 10, while FIGS. 4 and 5 illustrate subsequent steps. FIG. 3 shows the safety belt 12 wrapped around the waist 14 of the technician 16. The first end 34 of the single strap 18 is secured to the left ring 30, while the second end 36 of the single strap 18 is secured to the right ring 32. The single strap 18 thus hangs in one loop 62 behind the technician 16.

FIGS. 4 and 5 show an intermediate step. FIG. 4 is a front view of the technician 16, while FIG. 5 is a rear view of the technician 16. The technician 16 grasps the single strap 18, slides the first clasp 48 to a position between the legs, and pulls the single strap 18 between the legs. The technician 16 pulls the single strap 18 up through the groin area and secures the first clasp 48 to the left ring 30. One portion of the single strap 18, then, forms a left leg loop 64. As FIG. 5 shows, a remaining portion of the single strap 18 still dangles behind the technician 16.

Figure 6:
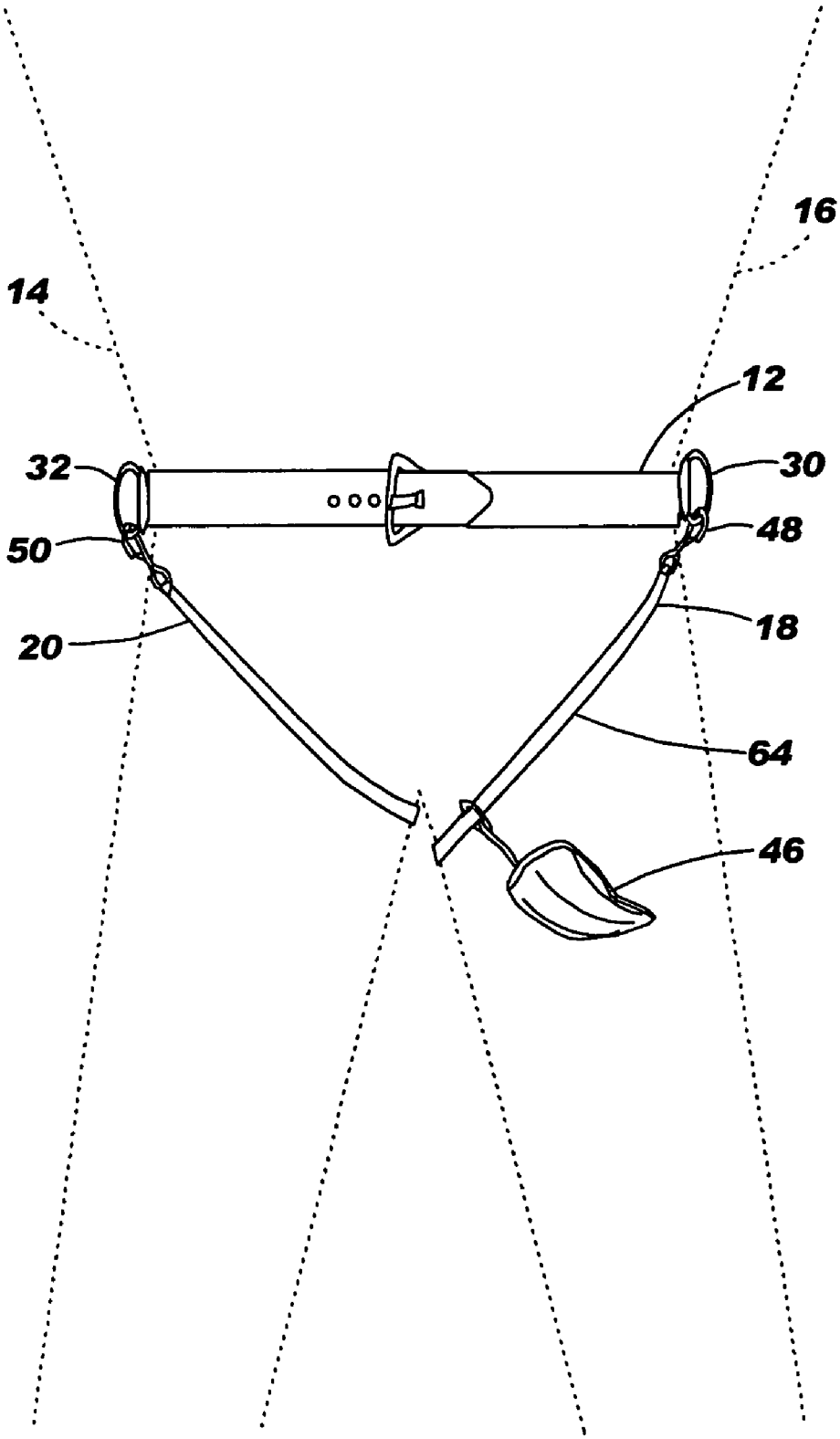
Figure 7:
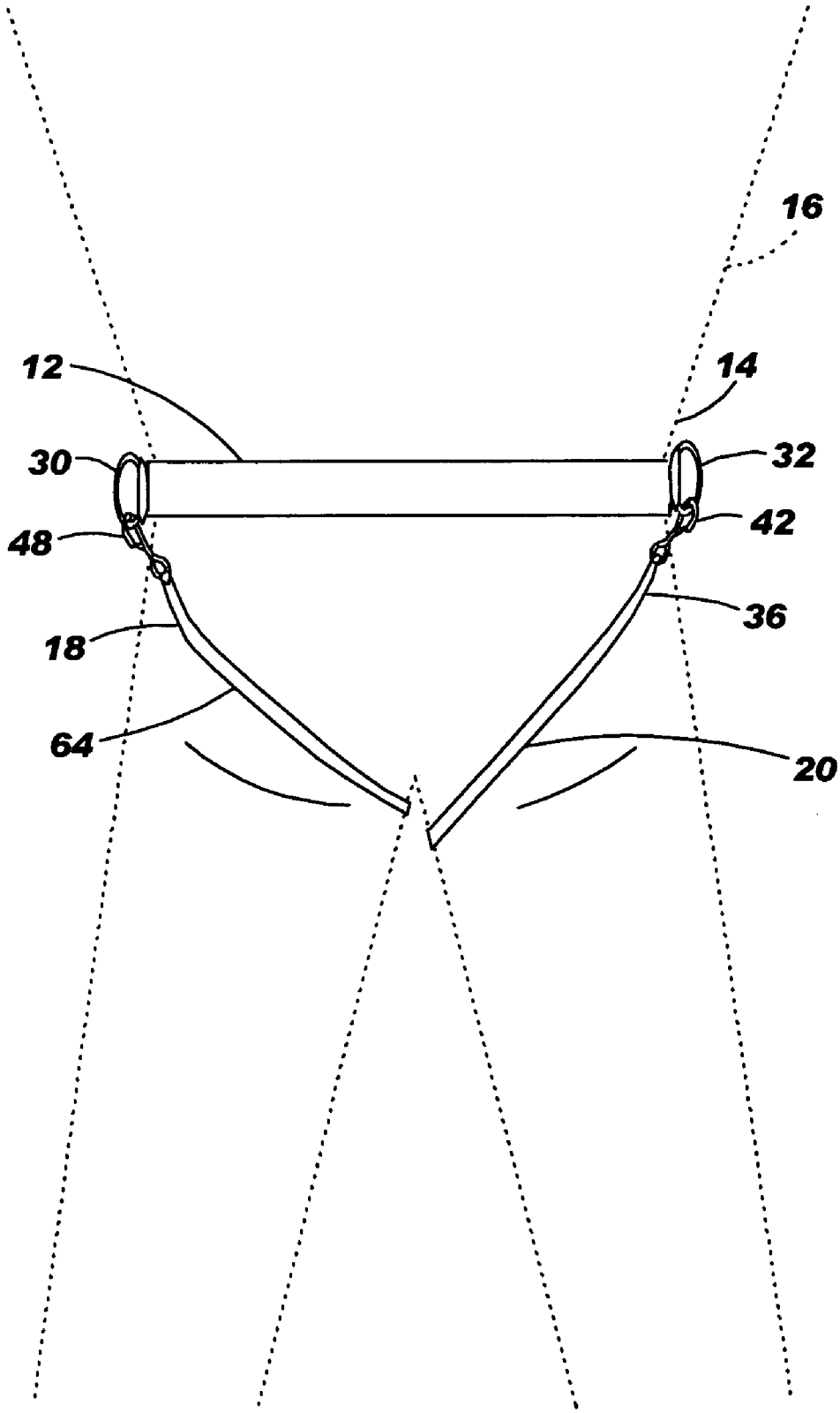

FIGS. 6 and 7 show a final step. FIG. 6 is a front view of the technician 16, while FIG. 7 is a rear view of the technician 16. Now that the left leg loop 64 is formed, the technician 16 forms the right leg loop 20. The technician 16 slides the second clasp 50 to a position between the legs. The technician 16 grasps the second clasp 50, pulls it up through the groin area, and secures the second clasp 50 to the right ring 32. Now that the left leg loop 64 and the right leg loop 20 are formed, the technician may also slide the groin protector 46 over the groin area. The technician 16 may now ascend the utility pole (shown as reference numeral 24 in FIG. 1) to a desired height. The technician 16 straddles the utility pole and performs a repair. If the technician's gaffs should "cut out," the groin protector 46 helps reduce injury from an impact to the groin area. If, however, the technician 16 should fall from the utility pole, the single strap 18, forming the left leg loop 64 and the right leg loop 20, helps retain the safety belt 12 around the waist 14 of the technician 16. Because the safety belt 12 is retained around the waist 14, the safety belt 12 is less prone to "slipping up" and injuring the ribs, chest, and other body areas.

The single strap 18 is preferably elastic. The single strap 18, as FIGS. 3–7 demonstrate, forms the left leg loop 64 and the right leg loop 20. These leg loops 20 and 64 should snuggly fit the technician to ensure the safety belt 12 does not slide toward the ribs and chest. The single strap 18, then, could be cut to an exact length to fit the technician's legs. The single strap 18 could additionally or alternatively include a buckle to adjust the length. The preferred embodiment, however, utilizes elastic cordage that stretches and contracts to snuggly fit the technician's legs. Returning, then, to FIG. 2, the single strap 18 may include a segment 66 of elastic cordage. This segment 66 of elastic cordage stretches and contracts to form the snuggly fitting right leg loop 20 and the left leg loop 64. Because the segment 66 of elastic cordage has elastic properties, the segment 66 of elastic cordage may have a length that accommodates varying heights and weights of technicians. The term "elastic" means the cordage absorbs energy and springs back to substantially its original length after being stretched. The elastic property of the cordage is popularly referred to as a "bungee cord," although many different construction techniques and processes can achieve the elastic property. The segment 66 of elastic cordage, for example, may have a rubber core with a braided, outer jacket. The segment 66 of elastic cordage may also have variously-oriented yarn fibers that stretch to produce the elastic property. The segment 66 of elastic cordage may also have an outer sheathing to reduce mechanical abrasion. The segment 66 of elastic cordage may also be constructed of high-temperature resistant material for fire retardness.

Figure 8:
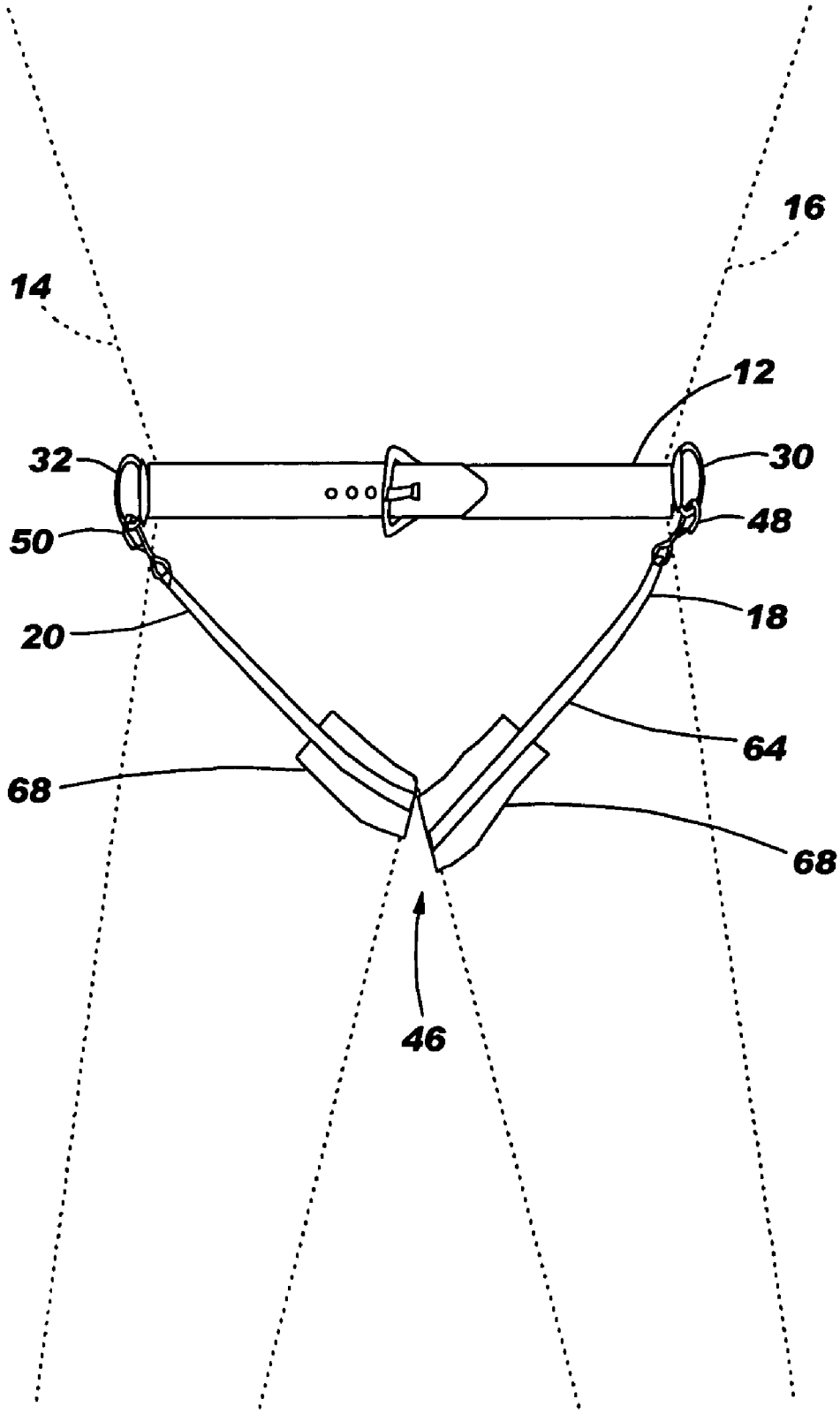
FIGS. 8 and 9 are schematics showing a variation of a groin protector shown in FIGS. 2–4 and 6.
Figure 9:
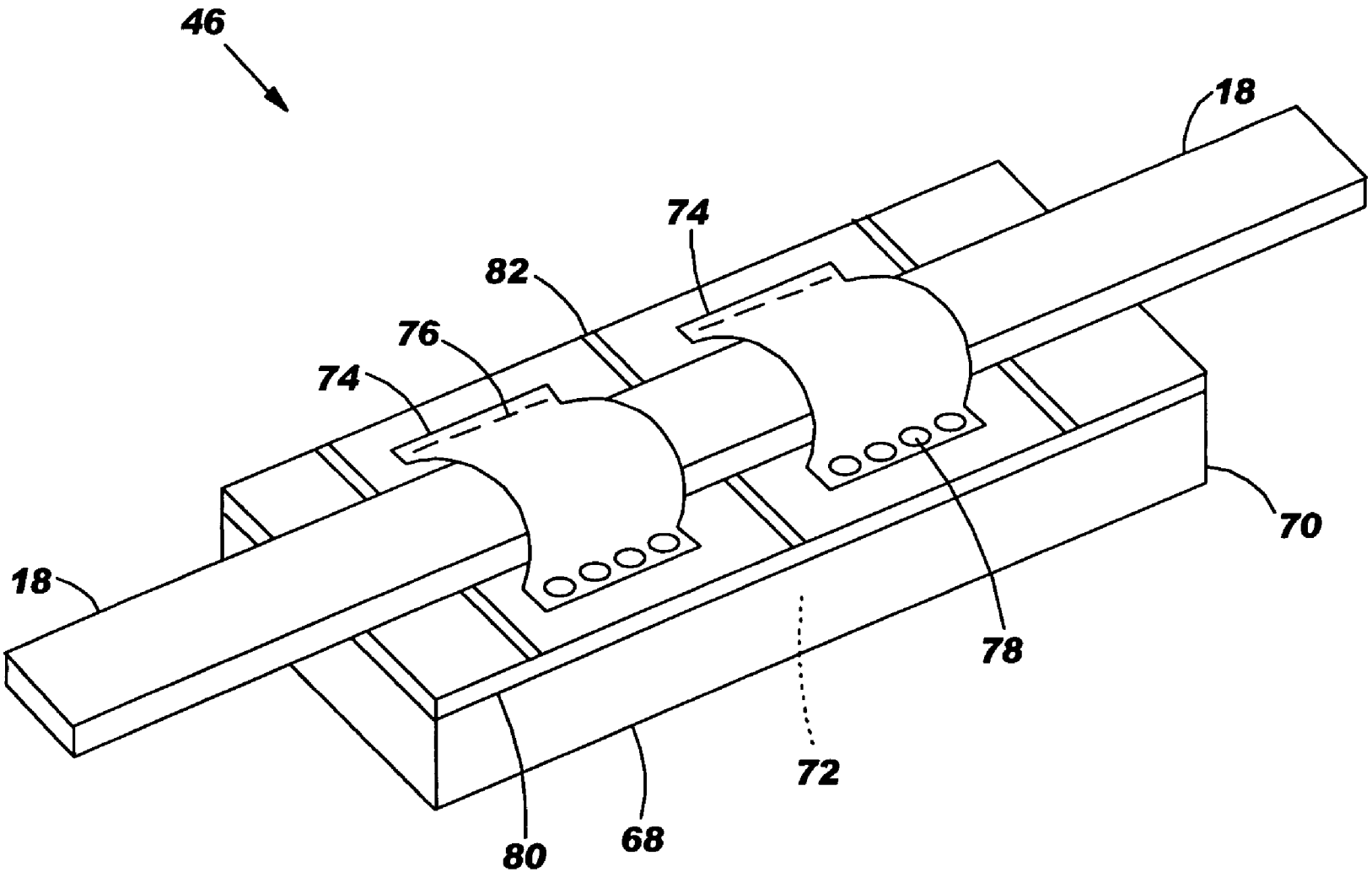

FIGS. 8 and 9 are schematics showing a variation of the groin protector 46. The groin protector 46 shown in FIGS. 2–4 and 6 may be awkward, or even embarrassing, for many technicians. Even though the groin protector 46 could provide great safety, some technicians may not be willing to utilize the device. FIGS. 8 and 9, then, show a variation of the groin protector 46. Here the groin protector 46 includes at least one groin pad 68. The at least one groin pad 68 slides along the single strap 18 and reduces injury from an impact to the groin area. As FIG. 9 shows, the groin pad 68 preferably has a breathable, outer covering 70 and a stuffed inner region 72. The groin pad 68 includes at least one loop 74, and the single strap 18 inserts into and through the loop 74. The at least one loop 74 may be attached to the outer covering 70 using threads 76 and/or rivets 78. The at least one loop 74 may additionally or alternatively utilize any means for chemically/mechanically attaching the loop 74, such as an adhesive, a staple, and/or a threaded fastener. The at least one hoop 74 could also be molded from a polymer material. The groin pad 68 may also include a rigid back plate 80 with at least one integrally molded hinge 82. The at least one molded hinge 82 allows the rigid back plate 80, and thus the groin pad 68, to conform to the curvature of the technician's leg and of the groin area. The technician may slide the groin pad 68 along the single strap 18 to the groin area. The at least one molded hinge 82 allows the groin pad 68 to conform and to reduce injury from an impact to the groin area.

Figure 10:
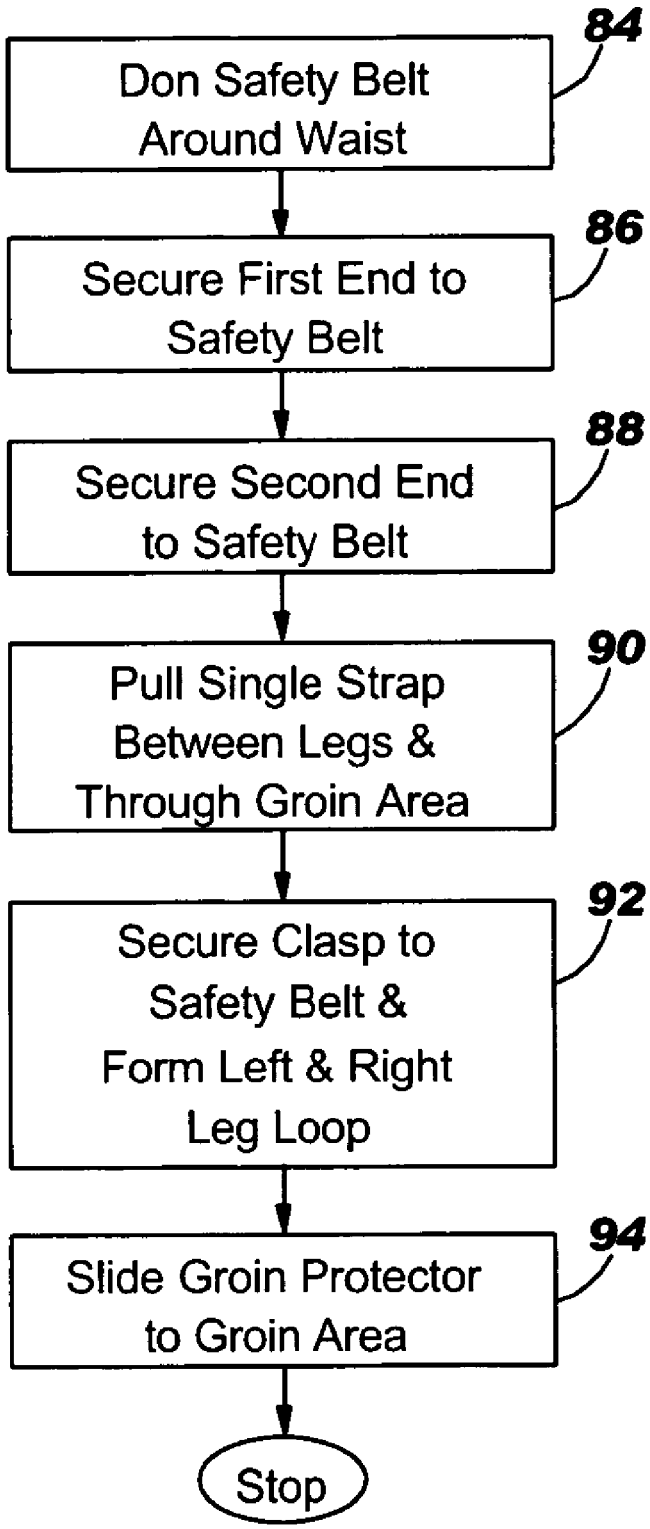
FIG. 10 is a flowchart showing a method for reducing injury from a fall from a utility pole.

FIG. 10 is a flowchart illustrating a method for reducing injury from a fall from a utility pole. A person, such as a technician, dons a safety belt around the waist (Block 84). A first end of a single strap is secured to the safety belt (Block 86), and the single strap has a clasp sliding along the single strap. A second end of the single strap is secured to the safety belt (Block 88). The single strap is pulled between the legs of the person and up through the groin area (Block 90). The clasp is then secured to the safety belt, thus forming a left and a right leg loop (Block 92). A groin protector is then slid along the single strap to the groin area of the person (Block 94).

While the present invention has been described with respect to various features, aspects, and embodiments, those skilled and unskilled in the art will recognize the invention is not so limited. Other variations, modifications, and alternative embodiments may be made without departing from the spirit and scope of the present invention.

What is claimed is:

1. A torso harness, comprising:

a safety belt for wrapping around the waist of a person;

a single strap for forming a left and a right leg loop, the single strap having a first end secured to the safety belt and a second end secured to the safety belt, the single strap also having a first clasp sliding along the single strap, the single strap for pulling between the legs of the person and up through the groin area, the first clasp securing to the safety belt, the single strap thus forming the left and the right leg loop; and a groin protector sliding between the left and the right leg loop, the groin protector reducing injury from an impact to the groin area, the groin protector comprising at least one groin pad having a breathable, outer covering and a stuffed inner region, the groin pad having at least one loop through which the single strap inserts, the at least one loop attached to the outer covering using threads and rivets, the groin pad also including a rigid back plate with at least one integrally molded hinge allowing the rigid back plate, and thus the groin pad, to conform to the curvature of the technician's leg.

2. A torso harness according to claim 1, further comprising a second clasp sliding along the single strap, the second clasp also securing to the safety belt, the single strap thus forming the left and the right leg loop.

3. A torso harness according to claim 1, wherein the single strap comprises a segment of elastic cordage.

4. A torso harness, comprising:

a safety belt for wrapping around the waist of a person; and a left and a right leg loop attached to the safety belt, the left and the right leg loops formed of a single strap, the left and the right leg loops for insertion of the corresponding legs of the person; and a groin protector sliding between the left and the right leg loop, the groin protector reducing injury from an impact to the groin area, the groin protector comprising at least one groin pad having a breathable, outer covering and a stuffed inner region, the groin pad having at least one loop through which the single strap inserts, the at least one loop attached to the outer covering using threads and rivets, the groin pad also including a rigid back plate with at least one integrally molded hinge allowing the rigid back plate, and thus the groin pad, to conform to the curvature of the technician's leg.

5. A torso harness according to claim 4, wherein the groin protector slides along a strap secured between the left and the right leg loop.

* * * * *